US008967176B2

(12) United States Patent
Connor

(10) Patent No.: US 8,967,176 B2
(45) Date of Patent: Mar. 3, 2015

(54) FUME BLOCKING DRAIN CAP

(76) Inventor: Blayne A. Connor, Gilbert, AZ (US)

( * ) Notice: Subject to any disclaimer, the term of this patent is extended or adjusted under 35 U.S.C. 154(b) by 862 days.

(21) Appl. No.: 13/106,104

(22) Filed: May 12, 2011

(65) Prior Publication Data

US 2011/0277229 A1 Nov. 17, 2011

Related U.S. Application Data

(60) Provisional application No. 61/333,980, filed on May 12, 2010.

(51) Int. Cl.
*E03C 1/282* (2006.01)
*F16K 17/40* (2006.01)
*E03F 5/04* (2006.01)

(52) U.S. Cl.
CPC ..... *E03F 5/0407* (2013.01); *E03F 2005/0416* (2013.01)
USPC ..... 137/15.17; 137/68.11; 137/362; 4/681

(58) Field of Classification Search
USPC ..... 137/68.11, 343, 356, 357, 362, 15.01, 137/15.05, 15.08, 15.11, 15.17, 15.18, 312, 137/313, 314; 4/293, 679, 681; 285/56–60; 239/309, 310
See application file for complete search history.

(56) References Cited

U.S. PATENT DOCUMENTS 434,680 A 8/1890 Regan et al.
699,982 A 5/1902 Seabury et al.
803,979 A 11/1905 Bonnell
1,739,067 A 12/1929 Fleming
2,003,770 A 6/1935 Goodhart
2,087,592 A 7/1937 Chesnut
3,209,732 A * 10/1965 Laken ..... 122/504
3,551,538 A * 12/1970 Ogura et al. ..... 264/49
3,565,106 A 2/1971 Baumbach
3,597,772 A 8/1971 Leavitt et al.
3,707,986 A 1/1973 Breen
3,787,650 A * 1/1974 Lewis ..... 200/61.04
4,098,287 A 7/1978 Baumbach
4,224,701 A 9/1980 Huang
4,372,311 A * 2/1983 Potts ..... 604/364
4,404,981 A * 9/1983 Valenti ..... 137/67
4,607,664 A 8/1986 Carney et al.
4,739,799 A 4/1988 Carney et al.
4,748,069 A * 5/1988 Cullen ..... 428/195.1
4,767,787 A * 8/1988 Kawata et al. ..... 514/573

(Continued)

OTHER PUBLICATIONS

Material Safety Data Sheet; Aqua-Clear, Inc.; "Water Soluble Tube"; Apr. 1, 2003; 4 pages.

*Primary Examiner* — John K Fristoe, Jr.
*Assistant Examiner* — Jonathan Waddy
(74) *Attorney, Agent, or Firm* — The Webb Law Firm

(57) ABSTRACT

A fume blocking drain cap could include a drain cap body having a top side and an underside defining at least one aperture extending therethrough and a dissolvable membrane attached to the underside of the drain cap body. The dissolvable membrane is arranged over the at least one aperture sealing the aperture from the underside of the drain cap body. A retainer ring may be provided that abuts the bottom surface of the dissolvable membrane to retain the dissolvable membrane against the underside of the drain cap body. The cap could also include a collar having an outside surface and inside surface. The collar is attached to and depends from the underside of the drain cap body and surrounds the dissolvable membrane.

22 Claims, 6 Drawing Sheets

(56) References Cited

U.S. PATENT DOCUMENTS

| | | | | |
|---|---|---|---|---|
| 5,019,346 | A | 5/1991 | Richter et al. | |
| 5,062,735 | A | 11/1991 | Gaudin | |
| 5,207,830 | A * | 5/1993 | Cowan et al. | 106/672 |
| 5,419,359 | A | 5/1995 | Kor | |
| 5,779,154 | A * | 7/1998 | Martin | 239/315 |
| 5,925,241 | A | 7/1999 | Aldridge et al. | |
| 6,053,197 | A | 4/2000 | Gorges | |
| 6,267,001 | B1 | 7/2001 | Duncan | |
| 6,273,124 | B1 | 8/2001 | Huber et al. | |
| 6,491,814 | B1 | 12/2002 | Wheeler | |
| 6,792,967 | B1 * | 9/2004 | Franklin | 137/312 |
| 6,795,987 | B2 | 9/2004 | Cornwall | |
| 6,899,122 | B1 * | 5/2005 | Mele | 137/312 |
| 6,959,723 | B2 | 11/2005 | Gorges | |
| 7,562,673 | B1 * | 7/2009 | Martin et al. | 137/312 |
| 7,992,230 | B2 * | 8/2011 | Millard | 4/295 |
| 2005/0283892 | A1 * | 12/2005 | Simeone et al. | 4/309 |
| 2007/0050901 | A1 | 3/2007 | Hung | |
| 2007/0174954 | A1 | 8/2007 | Millard | |
| 2009/0078408 | A1 | 3/2009 | Richard et al. | |
| 2009/0158513 | A1 | 6/2009 | Robles | |

* cited by examiner

FUME BLOCKING DRAIN CAP

CROSS REFERENCE TO RELATED APPLICATIONS

The present application claims priority to U.S. Provisional Patent Application No. 61/333,980, filed May 12, 2010, entitled "Fume Blocking Drain Cap", which is hereby incorporated by reference in its entirety.

BACKGROUND OF THE INVENTION

1. Field of the Invention

The present invention relates to drains and drain caps and, more specifically, to drain caps designed to prevent odors from emanating therethrough.

2. Description of Related Art

Floor drains, such as those in a basement or on a manufacturing facility floor, serve the important purpose of preventing flooding of a floor. These types of drains take in a number of different liquids and often have grates associated with the drain openings which prevent large particles from entering the drain. However, oftentimes small particles can pass through the grates and become trapped in the piping and/or plumbing associated with the drain. These particles and any residual liquid that may adhere to the walls of the associated piping can cause unpleasant and foul odors to emanate from the drain through the grate.

One such device which attempts to overcome this problem is disclosed in United States Patent Application Publication No. 2007/0050901. This publication discloses a drain sealing ring comprising a resilient diaphragm. Draining liquids act against the resilient force of the diaphragm to pass through the drain. However, when liquids are not passing through the drain, the diaphragm is biased against the sealing ring to create an airtight seal.

United States Patent Application Publication No. 2007/0050901, like many other currently available devices designed to reduce drain odor, the publication discloses devices which involve complex mechanical or fluid dynamic principles. The present invention seeks to overcome this deficiency in the prior art.

SUMMARY OF THE INVENTION

In one embodiment of the present invention, a fume blocking drain cap could include a drain cap body having a top side and an underside defining at least one aperture extending therethrough and a dissolvable membrane positioned against the underside of the drain cap body. The dissolvable membrane is arranged over the at least one aperture, sealing the aperture from the underside of the drain cap body. A retainer ring may be provided that abuts the bottom surface of the dissolvable membrane to retain the dissolvable membrane against the underside of the drain cap body. The cap could also include a collar having an outside surface and inside surface. The collar is attached to and depends from the underside of the drain cap body and surrounds the dissolvable membrane. The retainer ring could be adapted to apply a biasing force against the inside surface of the collar. The retainer ring could be a resilient ring and have a diameter greater than a diameter of the inside surface of the collar. In this manner, the retainer ring could be positioned in the collar in a compressed state to apply a biasing force against the collar, fixing the retainer ring in place and retaining the dissolvable membrane against the underside of the drain cap body.

The retainer ring and the collar could be placed in an interference fit arrangement, for example, by providing a ring receiving recess defined on the inside surface of the collar, wherein the retainer ring is received within the ring receiving recess to engage the retainer ring with the collar.

The drain cap body could define a plurality of apertures, the dissolvable membrane arranged over the plurality of apertures sealing the apertures from the underside of the drain cap body. The dissolvable membrane and the drain cap body could be disk-shaped, wherein the dissolvable membrane has a diameter that is less than the diameter of the drain cap body. The dissolvable membrane could include a water soluble paper, which could be sodium carboxymethyl cellulose. The water soluble paper could include 80% sodium carboxymethyl cellulose and 20% wood pulp fibers. The dissolvable membrane could also include poly(ethylene oxide). The dissolvable membrane could be adapted to dissolve over a period of less than one second when brought into contact with liquid, such as water. In one embodiment, the dissolvable membrane could be at least 0.0085 inches thick.

Another embodiment of the present invention is directed to a fume blocking drain cap that includes a drain cap body having a topside and an underside and defining a plurality of apertures extending therethrough; a collar having an outside surface and inside surface, the collar being attached to and depending from the underside of the drain cap body, wherein the collar surrounds the dissolvable membrane; a dissolvable membrane comprising water soluble paper positioned against the underside of the drain cap body, wherein the dissolvable membrane is arranged over the plurality of apertures sealing the apertures from the underside of the drain cap body; and a resilient retainer ring abutting a bottom surface of the dissolvable membrane to retain the dissolvable membrane against the underside of the drain cap body. In this embodiment, the collar defines a ring receiving recess, and the retainer ring has a diameter greater than a diameter of the inside surface of the collar; the retainer ring is in a compressed state and positioned within the collar to apply a biasing force against the collar fixing the retainer ring in the ring receiving recess, retaining the dissolvable membrane against the underside of the drain cap body; and the dissolvable membrane is adapted to dissolve over a period of less than one second when brought into contact with liquid.

Yet another embodiment of the present invention is directed to a method of retrofitting a drain with a drain cap. The method includes obtaining a cap having a cap body having a top side and an underside defining at least one aperture extending therethrough; securing a dissolvable membrane to an underside of a drain cap body; and placing the cap into a preexisting drain. It could also include securing a retainer ring to an inside surface of a cap collar attached to the underside of the cap, and the step of positioning a dissolvable membrane could include securing the dissolvable membrane between the underside of the cap and the retainer ring. A ring receiving recess can be provided on the inside surface of the cap collar, wherein securing the retainer ring to an inside surface of the cap collar includes placing the retainer ring in the ring receiving recess.

Another embodiment is directed to a replacement drain membrane for securing to a drain cap having a drain cap body having a top side and an underside and defining at least one aperture extending therethrough. The membrane includes a dissolvable disk adapted to be positioned against the underside of the drain cap body and seal the at least one aperture from the underside of the drain cap body, wherein the disk comprises a thickness of at least 0.0085 inches, wherein the disk is dissolvable within a period of time in the range of 0 to 45 minutes when in contact with liquid. The dissolvable disk could be water soluble paper, for example sodium carboxymethyl cellulose. The water soluble paper could be 80% sodium carboxymethyl cellulose and 20% wood pulp fibers. The dissolvable disk could also be poly(ethylene oxide).

BRIEF DESCRIPTION OF THE DRAWINGS

A more complete understanding of the fume blocking drain device can be obtained by considering the following description in conjunction with the accompanying drawing figures in which.

DESCRIPTION OF THE PREFERRED EMBODIMENTS

For purposes of the description hereinafter, spatial orientation terms, if used, shall relate to the referenced embodiment as it is oriented in the accompanying drawing figures or otherwise described in the following detailed description. However, it is to be understood that the embodiments described hereinafter may assume many alternative variations and embodiments and that the specific embodiments illustrated in the accompanying drawing figures and described herein are simply exemplary and should not be considered as limiting.

Figure 1:
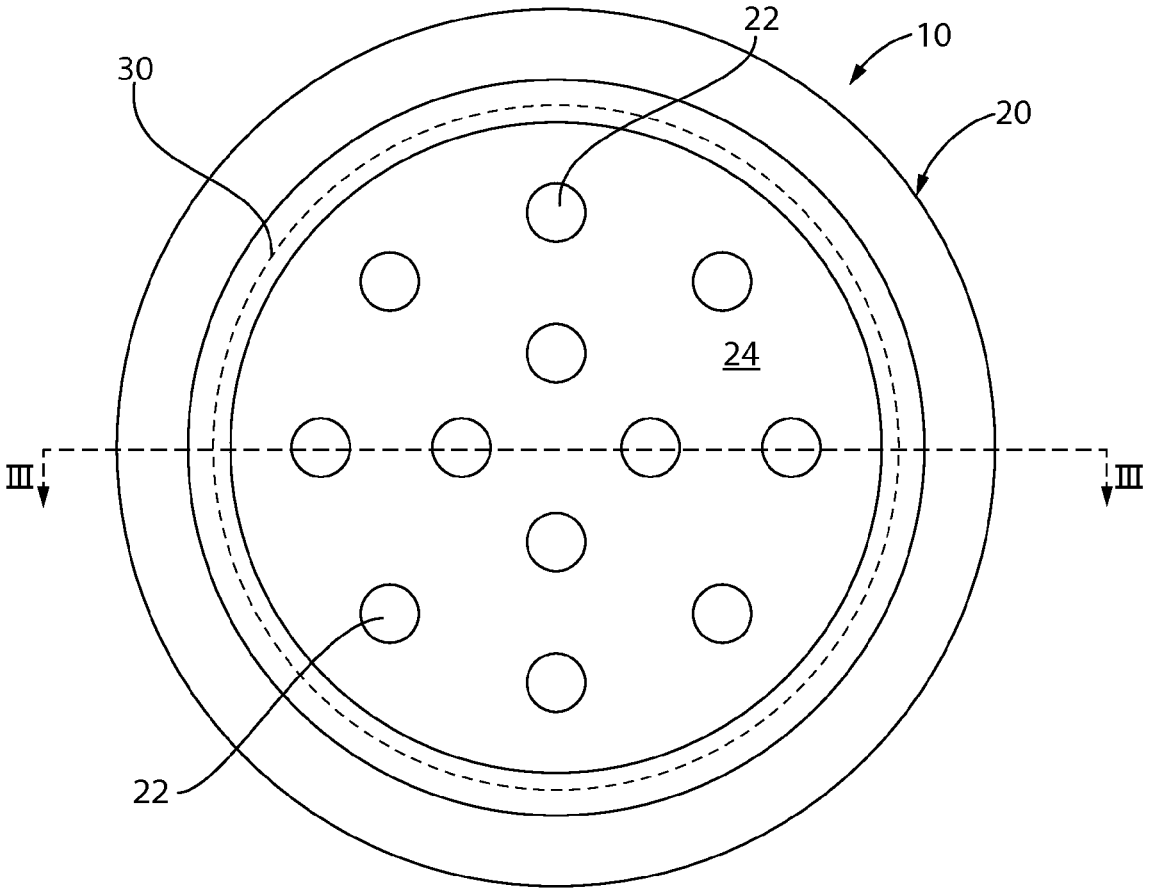
FIG. 1 is a top view of a fume blocking drain cap according to one embodiment of the present invention.
Figure 2:
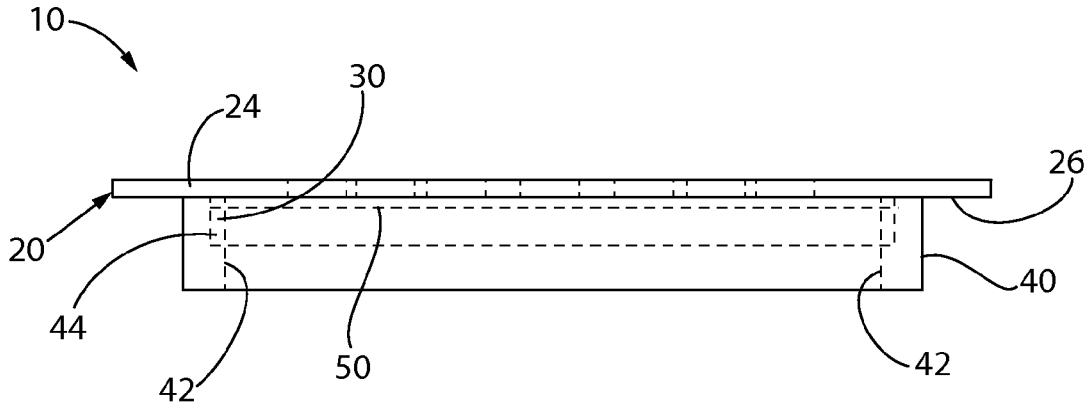
FIG. 2 is a side view of the fume blocking drain cap of FIG. 1.

As shown in FIGS. 1-2, in one embodiment of the present invention, a fume blocking drain cap 10 may comprise a drain cap body 20, a retainer ring 30, a collar 40, and dissolvable membrane 50. The retainer ring 30 is shown in broken lines on FIG. 1, which is a top view. The drain cap body 20 includes a top side 24 and an underside 26 with at least one aperture 22 or, as shown in the drawings, a plurality of apertures 22 defined therethrough for allowing drain liquids to pass through the drain cap body 20. The cap 10 also includes a dissolvable membrane 50, which is explained in more detail below.

Referring now to FIG. 2, the collar 40 may be attached to and depend from the underside 26 of the drain cap body 20 to surround the dissolvable membrane 50. The collar 40 may be a separate component. For example, the collar 40 and the drain cap body 20 may be constructed as two separate materials. Preferably, however, the collar 40 and the drain cap body 20 are formed of a single, integrally molded or extruded component, for example, polyvinyl chloride (PVC) or cast aluminum. Also shown in FIG. 2, in broken lines, are membrane 50 and retainer ring 30 abutting the bottom surface of the dissolvable membrane 50. The retainer ring 30 is positioned in a ring receiving recess 44 defined in an inside surface 42 of the collar 40, as shown by the broken lines of FIG. 2.

Figure 3:
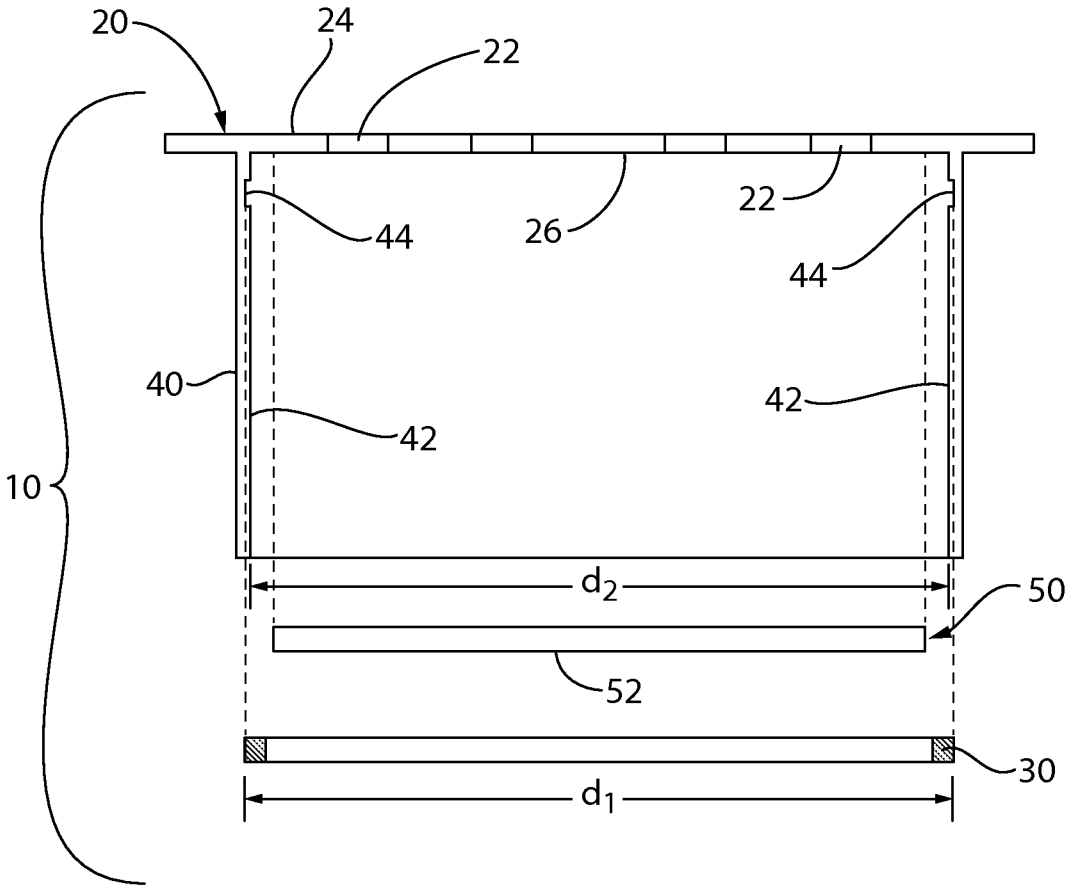
FIG. 3 is an exploded cross-sectional view of the fume blocking drain cap of FIG. 1 taken on the line III-III.
Figure 4:
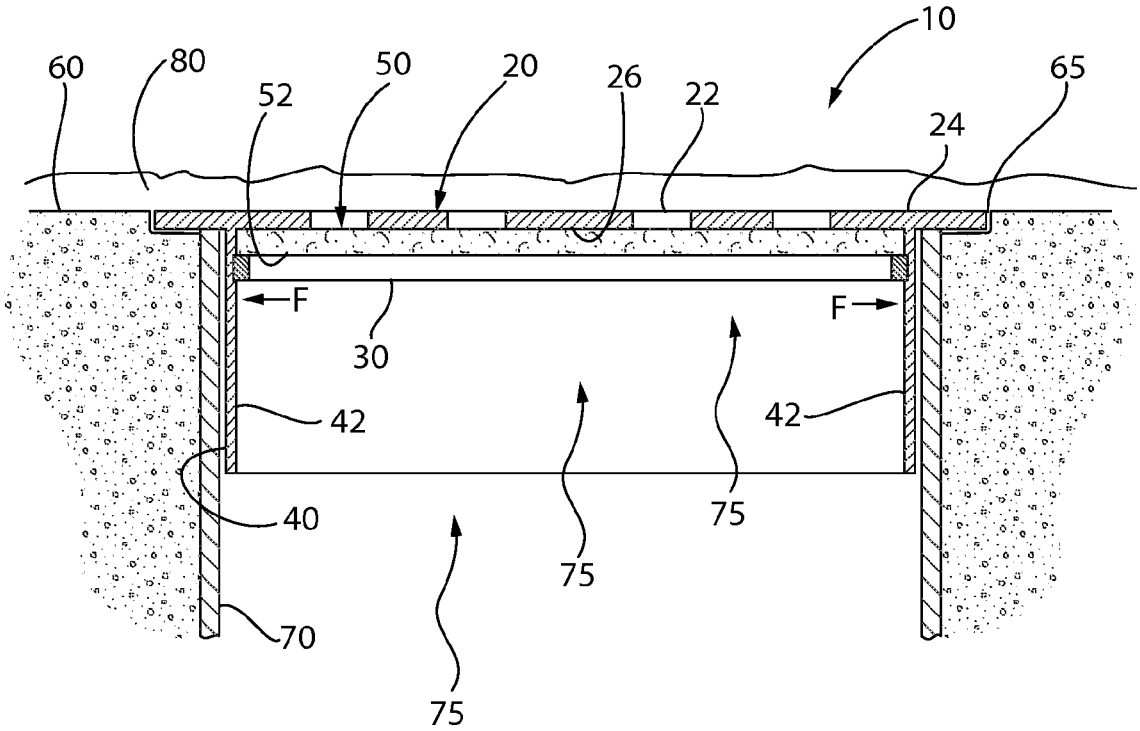
FIG. 4 is an assembled view of the cross-sectional view of the fume blocking drain cap of FIG. 3 positioned in a floor drain.
Figure 5:
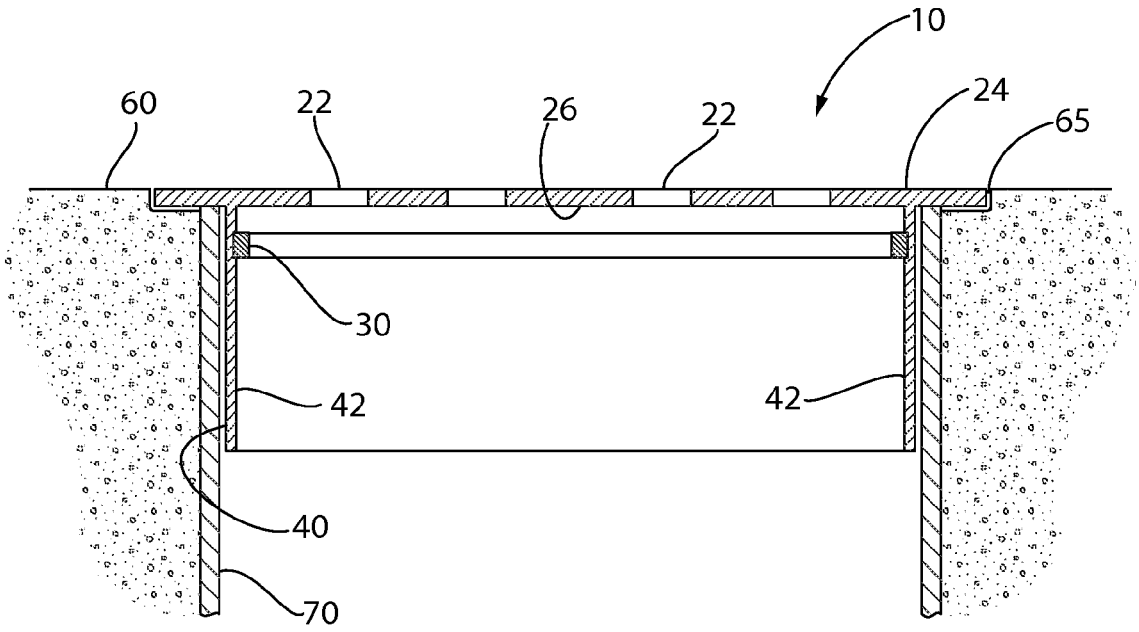
FIG. 5 is the cross-sectional view of FIG. 4 without a membrane according to the present invention.
Figure 6:
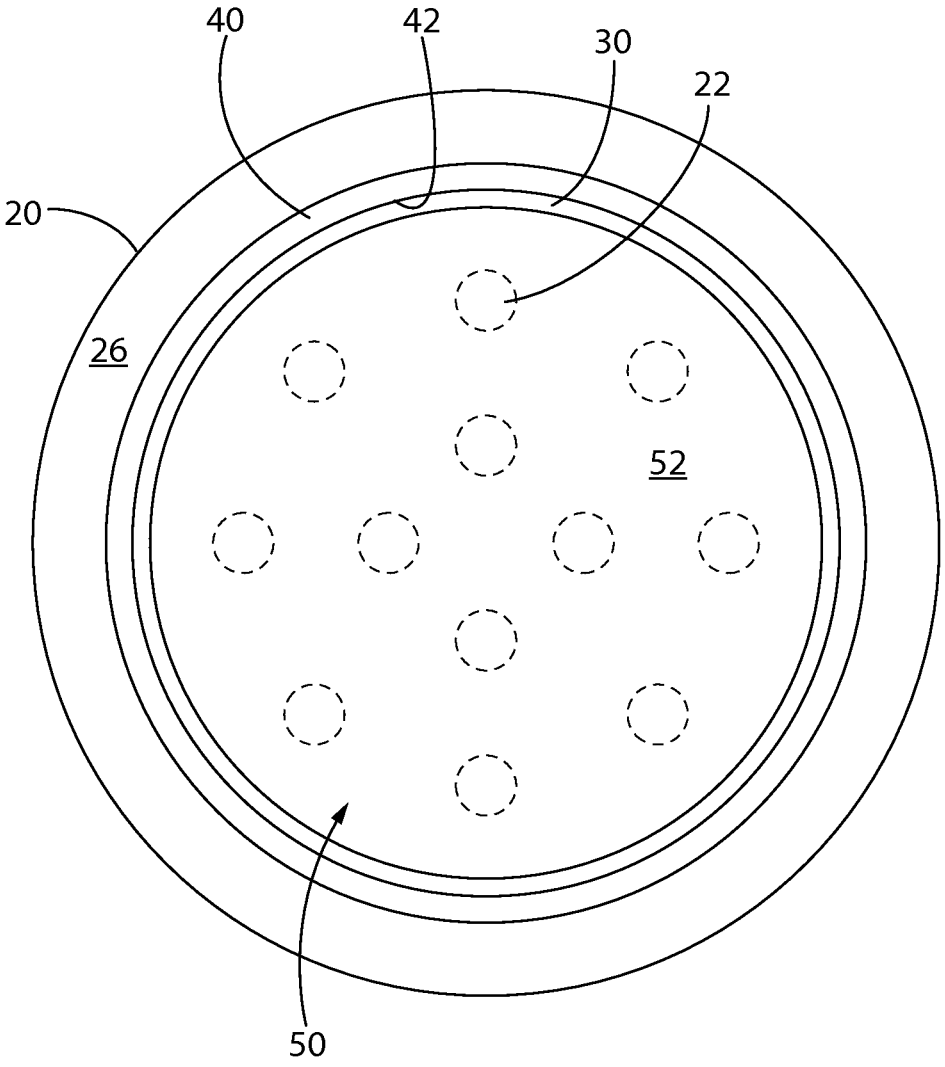
FIG. 6 is a bottom view of the fume blocking drain cap of FIG. 1.

Referring now to FIGS. 3-5, the membrane 50 is positioned against the underside 26 of the drain cap body 20, arranged such that it covers and seals the apertures 22 from the underside 26 of drain cap body 20. The membrane 50 is retained against the underside of the drain cap 20 by retainer ring 30, which abuts the bottom surface 52 of the membrane 50 securing the membrane against drain cap body 20. The retainer ring 30 can be received into a ring receiving recess 44, as best shown in FIG. 3, defined on the inside surface 42 of the collar 40 to engage the retainer ring 30 with the collar 40 in an interference fit arrangement. The diameter d1 of the retainer ring 30 could be greater than the diameter d2 of the inside surface 42 of collar 40. In this manner, the retainer ring 30 could be constructed of a resilient material, such that retainer ring 30 could be compressed to fit into ring receiving recess 44, wherein subsequent expansion of the retainer ring 30 will cause a biasing force F to be exerted by the retainer ring 30 against the inside surface 42 of the collar 40, as shown in FIG. 4. Accordingly, the retainer ring 30 is fixed in place, biasing the bottom surface 52 of the membrane 50, thereby retaining the membrane 50 against the underside 26 of the drain cap body 20 and maintaining a seal over the apertures 22. As shown in the bottom view of FIG. 7, the membrane 50 seals the apertures 22, which are shown in broken lines, from the underside 26 of the drain cap body 20.

The dissolving membrane 50 may be disk-shaped, thereby mirroring the shape of the drain cap body 20, shown in FIGS. 1-5, which may also be disk-shaped. However, any shape or thickness for a particular application is contemplated by the present invention.

As shown in FIG. 3, the drain cap body 20 may have a diameter d3 with the remaining components of the fume blocking drain cap 10, i.e., the retainer ring 30, the collar 40 and the membrane 50, having a diameter less than that of the drain cap body 20, e.g., diameter d2 of collar 40 and diameter d1 of retainer ring 30. The diameter of the drain cap body 20 could range, for example, between 3 and 5 inches.

The dissolving membrane 50 may be manufactured from an industrial soap material, such as a soap material from the oil and gas industry. Two materials that may be used to form the membrane are a water soluble paper or poly(ethylene oxide). These materials are commercially available and can be obtained, for example, from Aqua-Clear, Inc. of Charleston, W. Va. The water soluble paper may comprise a composition of approximately 80% sodium carboxymethyl cellulose and 20% wood pulp fibers. The paper may be approximately 0.0085 inches thick. Depending on the material and/or thickness of the membrane 50 used, the dissolve rate may vary. When in contact with water or another liquid, the membrane 50 may dissolve over a range of time varying from instantly to approximately forty-five minutes. A 0.0085 inch thick single layer of water soluble paper membrane may dissolve immediately upon contact with liquid, for example, less than one second. Poly(ethylene oxide) soap, on the other hand, may require between 30 and 40 minutes to dissolve after coming into contact with water or another liquid. The poly(ethylene oxide) soap is more optimized for salt water applications. These materials are environmentally harmless and will not cause damage or be toxic to a drainage system.

When installed in a drain 65 in a floor 60, as shown in FIGS. 4-5, the collar 40 will extend into drain piping 70, with the retainer ring 30 biasing against the inside surface of the collar 40. Because the membrane 50 seals the apertures 22 from the underside of the drain cap 20, fumes and odors, represented by arrows 75, will be incapable of emanating from the piping 70 of the drain 65 in floor 60.

Referring now to FIGS. 4-5, in use, the drain cap 10 may be a floor drain, for example, on the floor 60 of a manufacturing facility. Oftentimes, flooding on the facility floor may occur due to leakage, spillage, or other hazards. When this occurs, the hazard liquid 80 will pool, as illustrated in FIG. 4, at a point near the drain cap 10 because the apertures 22 of drain cap body 20 will be sealed by the membrane 50. Therefore, the liquid will contact the membrane 50, as opposed to draining immediately through the apertures 22. After a short period of time, which may, for example, be instant to approximately 30 minutes, depending on the membrane material and thickness used, the membrane 50 will dissolve due to its exposure to the liquid 80 through apertures 20. The liquid 80 can then drain, thereby disposing of the flooding hazard. A drain cap 10 after the membrane 50 has been dissolved and the liquid 80 allowed to drain is shown in FIG. 5. If an industrial soap material is used, the membrane 50 may only dissolve at points that correspond to the apertures, and residual membrane 50 will remain on the underside of the drain cap 20. The drain cap 20 may then be removed and the dissolved membrane 50 replaced, by removing the retainer ring 30 from within collar 40 and removing what remains of the dissolved membrane 50. A new membrane 50 may then be placed against the underside of the drain cap 20, thereby resealing the apertures 22 of the drain cap 20. In the case of water soluble paper, the entire membrane 50 is likely to dissolve, including the portions not in direct contact with the liquid via the apertures 22, such as illustrated in FIG. 5. In this case, the residual membrane will not need to be removed and a new membrane 50 may simply be placed against the underside of the drain cap 20 after removing the retainer ring. Accordingly, odors and other hazardous fumes and contaminates, either sent down the drain with the flood liquid 80 or previously present in the drain piping, will not emanate through the apertures 22 of drain 20 due to the seal produced by membrane 50.

Figure 7:
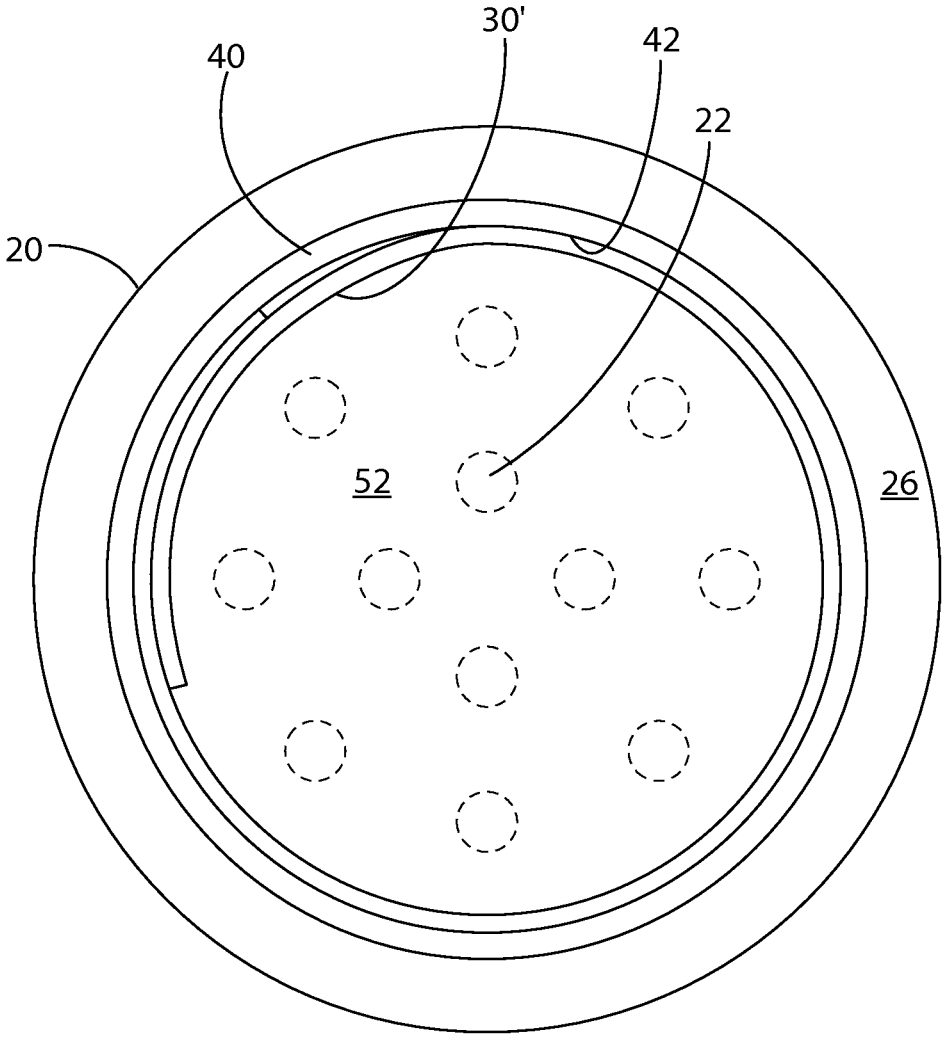
FIG. 7 is a bottom view of the fume blocking drain cap of FIG. 1, including an alternative embodiment of a retainer ring.
Figure 8:
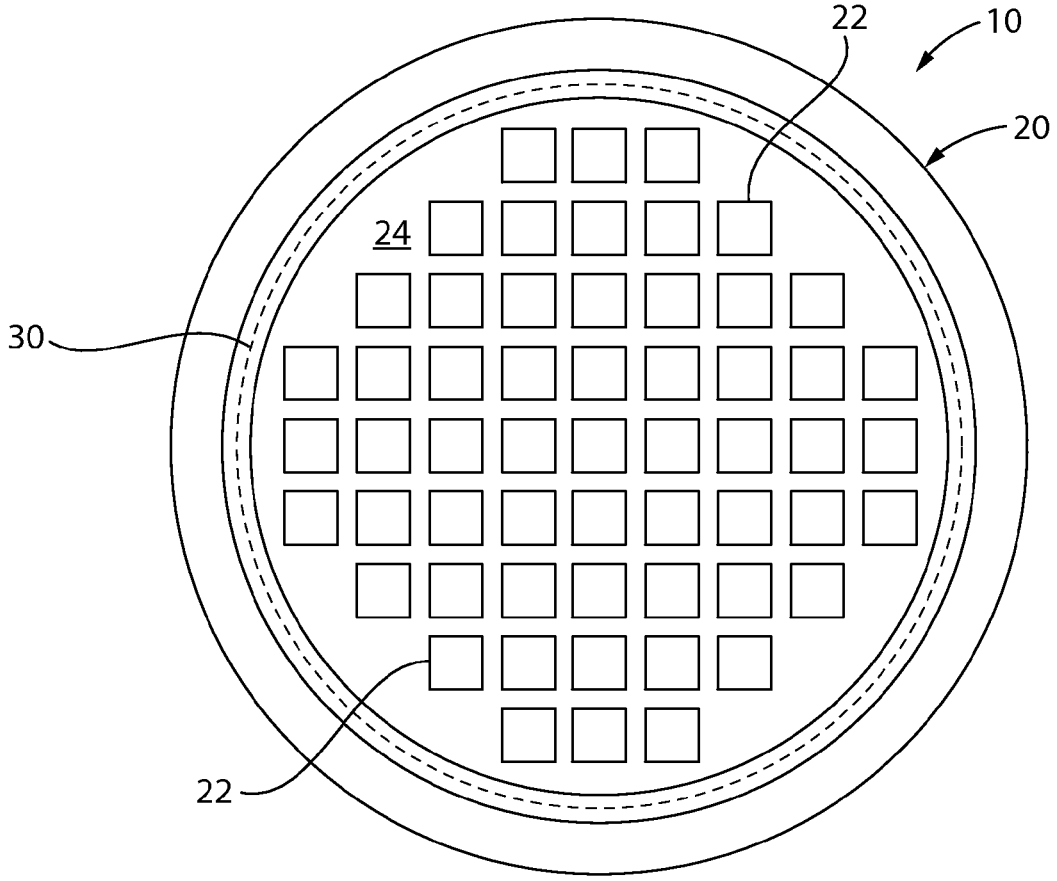
FIG. 8 is a top view of another embodiment of a fume blocking drain cap according to the present invention.

As shown in FIG. 7, in an alternative embodiment, retainer ring 30' may comprise a spring-loaded open-ended coiled ring. When the spring loaded retainer ring 30' is placed inside the collar 40, it is compressed by coiling it to fit within the collar 40. The ring 30' then subsequently expands, thereby engaging a chamfer 44 on the inside surface of the collar 40 and applying a biasing force against the inside surface of the collar 40, such that the retainer ring 30' is fixedly maintained in position like retainer ring 30, shown in FIGS. 1-6.

Figure 9:
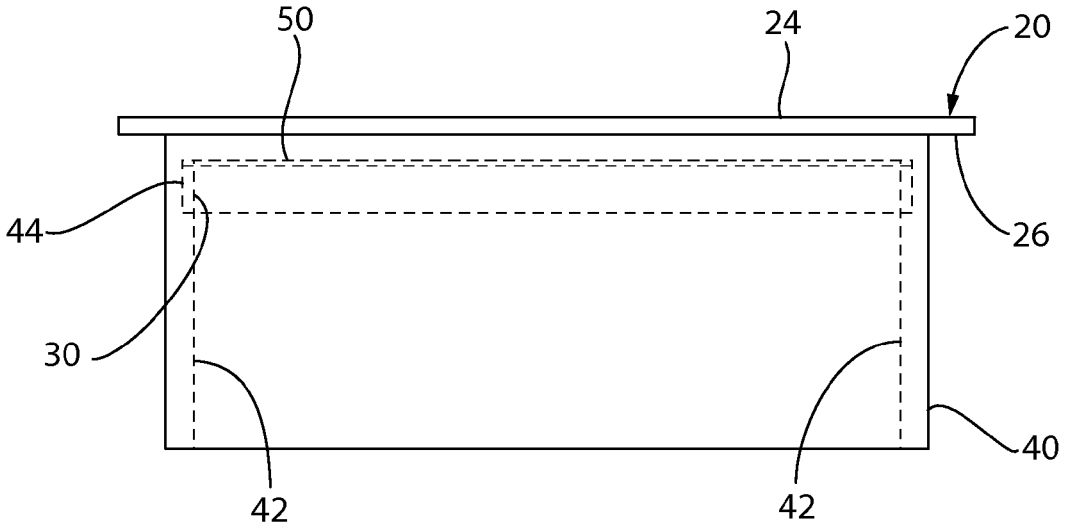
FIG. 9 is a side view of the fume blocking drain cap of FIG. 8.

Referring now to FIGS. 9-10, an alternative embodiment of a drain cap 10' is shown. This embodiment includes a different arrangement of the plurality of apertures 22' than that of the drain cap 10 in FIGS. 1-7 and an extended collar 40. As shown, the apertures 22' are square-shaped, as opposed to the circular apertures illustrated in FIGS. 1-8. Other than these specific differences, the construction and operation of drain cap 10' is substantially identical to that of drain cap 10 explained above.

The above-described fume blocking drain caps may be retro-fitted to an existing drain, wherein, for example, the drain cap body 20 may be a universal drain cap used in conjunction with a pre-existing drain, with the remaining components, the retainer ring 30, the collar 40, and the membrane 50, being subsequently attached thereto. Alternatively, the entire fume blocking drain cap 10 may be manufactured as a complete retro-fit cap, completely replacing a pre-existing drain cap in conjunction with a pre-existing drain.

While specific embodiments of the invention have been described in detail, it will be appreciated by those skilled in the art that various modifications and alternatives to those details could be developed in light of the overall teachings of the disclosure. The presently preferred embodiments described herein are meant to be illustrative only and not limiting as to the scope of the invention, which is to be given the full breadth of the appended claims and any and all equivalents thereof.

The invention claimed is:

1. A method of retrofitting a floor drain with a floor drain cap:

obtaining a cap having a cap body having a top side and an underside defining a plurality of apertures extending therethrough;

sealing the apertures from the underside of the drain cap body by positioning a dissolvable membrane against the underside of the drain cap body, such that the dissolvable membrane is arranged over the plurality of apertures from the underside of the drain cap body; and placing the cap into a preexisting floor drain.

2. The method of claim 1, further comprising the step of securing a retainer ring to an inside surface of a cap collar attached to the underside of the cap, wherein the step of positioning a dissolvable membrane comprises securing the dissolvable membrane between the underside of the cap and the retainer ring.

3. The method of claim 2, further comprising the step of providing a ring receiving recess positioned annularly about and being recessed from the inside surface of the cap collar, wherein the step of securing the retainer ring to an inside surface of the cap collar comprises placing the retainer ring in the ring receiving recess.

4. A fume blocking floor drain cap comprising:

a drain cap body having a top side and an underside and defining a plurality of apertures extending therethrough, wherein, in use, the drain cap body is positioned in a floor drain; and a dissolvable membrane positioned against the underside of the drain cap body, wherein the dissolvable membrane is arranged over the plurality of apertures sealing the apertures from the underside of the drain cap body.

5. The fume blocking drain cap of claim 4, further comprising a retainer ring abutting a bottom surface of the dissolvable membrane to retain the dissolvable membrane against the underside of the drain cap body.

6. The fume blocking drain cap of claim 4, further comprising a collar having an outside surface and inside surface, the collar being attached to and depends from the underside of the drain cap body, wherein the collar surrounds the dissolvable membrane.

7. The fume blocking drain cap of claim 6, further comprising a retainer ring abutting a bottom surface of the dissolvable membrane to retain the dissolvable membrane against the underside of the drain cap body, wherein the retainer ring is adapted to apply a biasing force against the inside surface of the collar.

8. The fume blocking drain cap of claim 7, wherein the retainer ring comprises a resilient ring having a diameter greater than a diameter of the inside surface of the collar, the retainer ring being in a compressed state and positioned within the collar to apply the biasing force against the collar fixing the retainer ring in place and retaining the dissolvable membrane against the underside of the drain cap body.

9. The fume blocking drain cap of claim 8, wherein the retainer ring and the collar are in an interference fit arrangement.

10. The fume blocking drain cap of claim 9, wherein the inside surface of the collar defines a ring receiving recess positioned annularly about and being recessed from the innermost portion of the inside surface of the collar for receiving the retainer ring, the retainer ring being received within the ring receiving recess engaging the retainer ring with the collar.

11. The fume blocking drain cap of claim 4, wherein the dissolvable membrane and the drain cap body are disk-shaped.

12. The fume blocking drain cap of claim 4, wherein the dissolvable membrane comprises a water soluble paper.

13. The fume blocking drain cap of claim 12, wherein the water soluble paper comprises sodium carboxymethyl cellulose.

14. The fume blocking drain cap of claim 13, wherein the water soluble paper comprises 80% sodium carboxymethyl cellulose and 20% wood pulp fibers.

15. The fume blocking drain cap of claim 4, wherein the dissolvable membrane comprises poly(ethylene oxide).

16. The fume blocking drain cap of claim 4, wherein the dissolvable membrane is adapted to dissolve between a period of time in a range of 0 seconds to 45 minutes when brought into contact with liquid.

17. The fume blocking drain cap of claim 16, wherein the liquid comprises water.

18. The fume blocking drain cap of claim 4, wherein the dissolvable membrane is at least 0.0085 inches thick.

19. A fume blocking floor drain cap comprising:

a drain cap body having a topside and an underside and defining a plurality of apertures extending therethrough, wherein, in use, the drain cap body is positioned in a floor drain;

a collar having an outside surface and inside surface, the collar being attached to and depending from the underside of the drain cap body;

a dissolvable membrane comprising water soluble paper positioned against the underside of the drain cap body, wherein the dissolvable membrane is arranged over the plurality of apertures sealing the apertures from the underside of the drain cap body, and wherein the collar surrounds the dissolvable membrane; and a resilient retainer ring abutting a bottom surface of the dissolvable membrane to retain the dissolvable membrane against the underside of the drain cap body, wherein the collar defines a ring receiving recess positioned annularly about and being recessed from the inside surface of the collar for receiving the retainer ring, the retainer ring having a diameter greater than a diameter of the inside surface of the collar, the retainer ring being in a compressed state and positioned within the collar to apply a biasing force against the collar fixing the retainer ring in the ring receiving recess retaining the dissolvable membrane against the underside of the drain cap body, and wherein the dissolvable membrane is adapted to dissolve over a period of time in the range 0 seconds to 45 minutes when brought into contact with liquid.

20. A replacement drain membrane for securing to a drain cap having a drain cap body having a top side and an underside and defining at least one aperture extending therethrough, the membrane comprising:

a dissolvable disk comprising water soluble paper comprising sodium carboxymethyl cellulose adapted to be positioned against the underside of the drain cap body and seal the at least one aperture from the underside of the drain cap body, wherein the disk comprises a thickness of at least 0.0085 inches, wherein the disk is dissolvable within a period of time in the range of 0 seconds to 45 minutes when in contact with liquid.

21. The membrane of claim 20, wherein the water soluble paper comprises 80% sodium carboxymethyl cellulose and 20% wood pulp fibers.

22. A replacement floor drain membrane for securing to a floor drain cap having a drain cap body having a top side and an underside and defining at least one aperture extending therethrough, and being positioned in a floor drain, the membrane comprising:

a dissolvable disk comprising poly(ethylene oxide) adapted to be positioned against the underside of the drain cap body and seal the at least one aperture from the underside of the drain cap body, wherein the disk comprises a thickness of at least 0.0085 inches, wherein the disk is dissolvable within a period of time in the range of 0 seconds to 45 minutes when in contact with liquid.

* * * * *